United States Patent [19]

Young

[11] 4,010,952

[45] Mar. 8, 1977

[54] TABLE GAME

[76] Inventor: Robert J. Young, 5111 Virginia Ave., SE., Charleston, W. Va. 25304

[22] Filed: July 25, 1975

[21] Appl. No.: 599,021

[52] U.S. Cl. ..... 273/30

[51] Int. Cl.[2] ..... A63B 39/00

[58] Field of Search ..... 273/30, 85 R, 85 D, 273/122 R, 122 AD, 124 R, 124 A, 125 R, 125 A, 127 C, 11 R

[56] References Cited

UNITED STATES PATENTS

| | | | |
|---|---|---|---|
| 1,153,719 | 9/1915 | Simmons | 273/125 R X |
| 3,228,688 | 1/1966 | Dennison | 273/85 R |

FOREIGN PATENTS OR APPLICATIONS

| | | | |
|---|---|---|---|
| 764,424 | 5/1934 | France | 273/85 D |
| 445,087 | 2/1949 | France | 273/85 R |
| 239,553 | 2/1946 | Switzerland | 273/85 R |
| 241,926 | 8/1946 | Switzerland | 273/85 R |
| 856 | 1/1905 | United Kingdom | 273/30 |

*Primary Examiner*—Richard C. Pinkham
*Assistant Examiner*—T. Brown
*Attorney, Agent, or Firm*—Bacon & Thomas

[57] ABSTRACT

A table game, which is played by two or four persons, using a ball and paddles, and wherein the playing surface is divided by a net into two courts, as in the game of table tennis. Apertures in the playing surface are provided for catching the ball and each aperture is overlapped by an associated platform set at an angle to the playing surface. The apertures and associated platforms in each court open towards the opponent's court. Markings on the playing surface designate courts and half courts, and a singles service path and a doubles service path.

11 Claims, 8 Drawing Figures

TABLE GAME

BACKGROUND OF THE INVENTION

1. Field of the Invention

This invention relates to table games and more specifically to table tennis games played with ball and paddle across a playing surface divided into two equal courts by a net.

2. Description of the Prior Art

Table tennis games played with ball and paddle, where the net is the only barrier, are well known. Variations on this type of game are known wherein an aperture or plurality of apertures or targets are employed on the playing surface; see, for example, U.S. Pat. No. 3,001,791, issued to Atwood and U.S. Pat. No. 3,117,783, issued to Reid. Only a modicum of additional skill is needed to play these variations of table tennis over the original game.

SUMMARY OF THE INVENTION

A table tennis game, played by two or four persons, with paddle and ball, is played on a rectangular playing surface wherein a net divides the playing surface into two courts. Each court has a plurality of apertures overlapped by associated platforms set at an angle to the playing surface and opening towards the opponent's court. The playing surface itself is marked by a plurality of lines which divided the playing surface into courts and half courts and also designate a singles service path and a doubles service path.

Accordingly, it is an object of the present invention to provide a table game having apertures in the playing surface overlapped by associated platforms.

It is an additional object of the present invention to provide a table game wherein the playing surface is marked by a plurality of lines which divide the playing surface into courts and half courts and which also designate a singles service path and a doubles service path.

It is a further object of the present invention to provide a table game wherein the playing surface has apertures overlapped by associated platforms and a plurality of markings which divide the playing surface into courts and half courts and also designate a singles service path and a doubles service path, the apertures and associated platforms being equally divided between the courts and symmetrically arranged on the half courts.

BRIEF DESCRIPTION OF THE DRAWINGS

The above objects of the invention as well as other objects and features of the invention will be more clearly understood, if reference is made to the following description, and accompanying drawings wherein.

DESCRIPTION OF THE PREFERRED EMBODIMENT

The following description of the preferred embodiment includes examples of colors and dimensions. Naturally, other colors and dimensions could be used.

Figure 1:
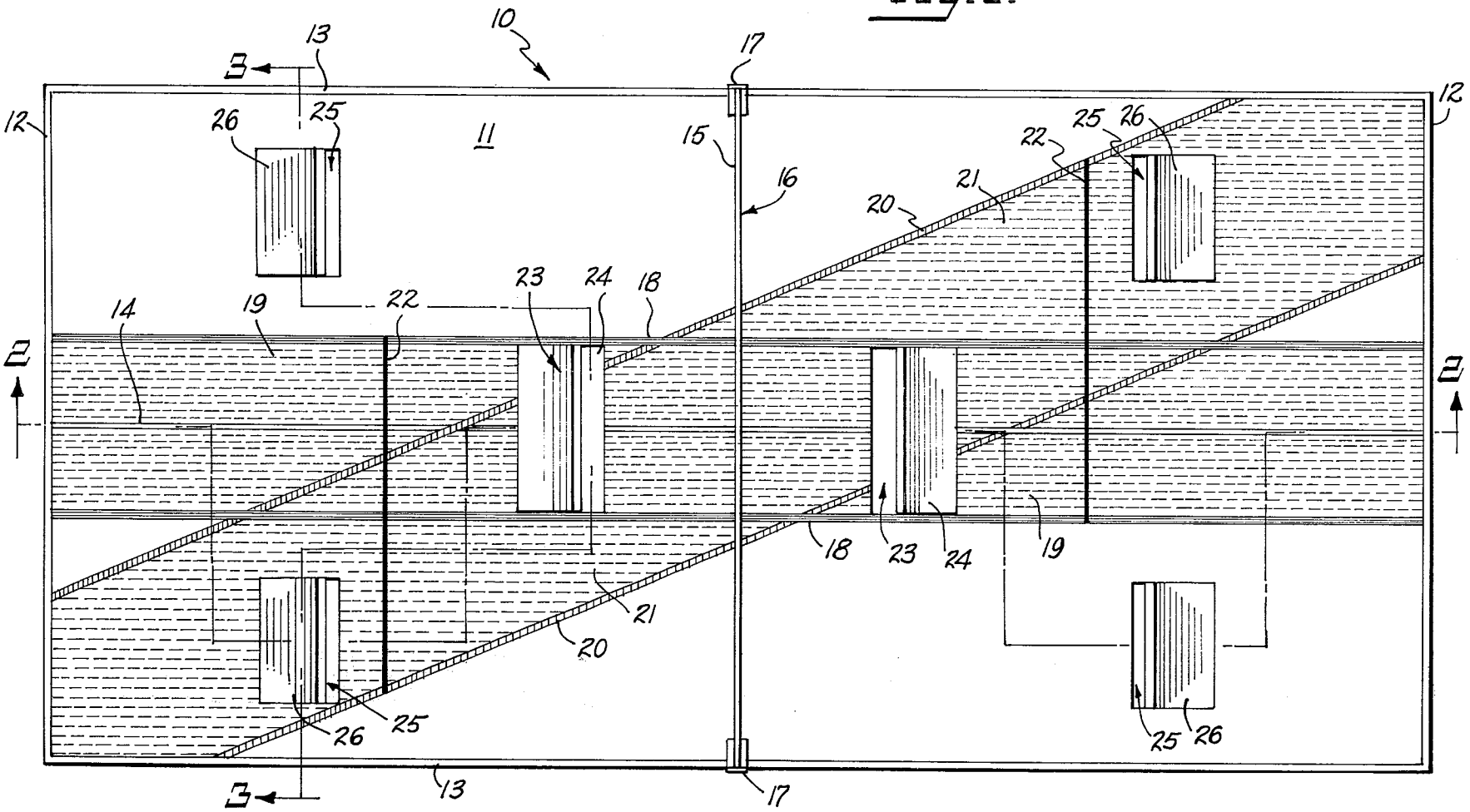
FIG. 1 is a plan view of a table game of the present invention.
Figures 2, 3, 4, 5:
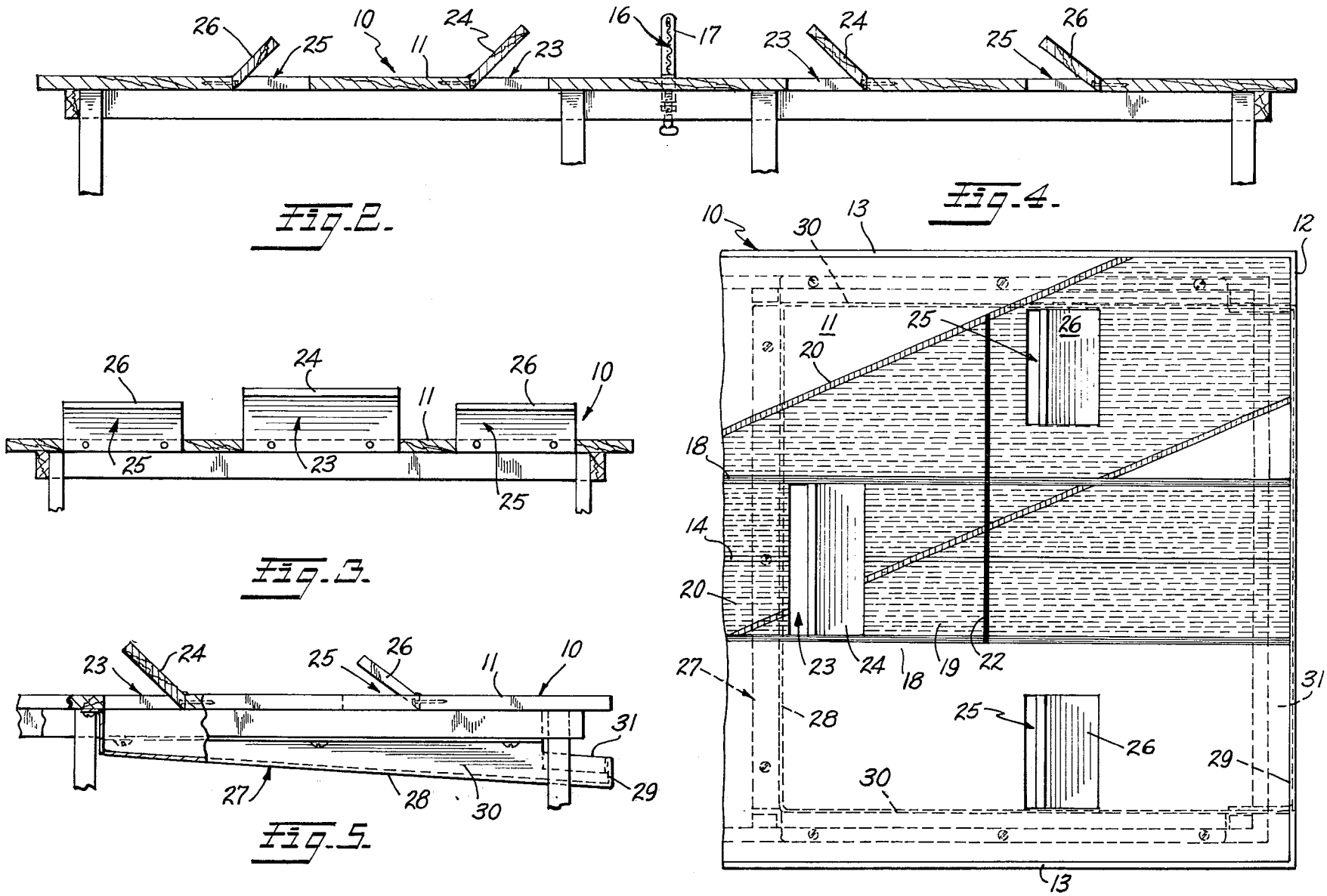
FIG. 2 is a longitudinal vertical sectional view, taken on line 2—2 of FIG. 1.
FIG. 3 is a transverse vertical sectional view, taken on the line 3—3 of FIG. 1.
FIG. 4 is a fragmentary plan view of the table game showing a ball return arrangement.
FIG. 5 is a fragmentary side elevational view, partly in section of the table game of FIG. 4.

As shown in FIGS. 1, 2 and 3, a table 10 has a rectangular playing surface 11, eight feet in length by four feet in width. The table 10 rests so that a playing surface 11 is 28 inches above the floor and lies in a horizontal plane. The playing surface 11 is made of any material which yields a uniform bounce of not less than 8 inches and not more than 9 inches when a standard table tennis ball is dropped from a height of 12 inches above its surface.

The playing surface 11 is marked with a one-half inch broad white line along its edges. A pair of lines along the four foot sides are termed end boundaries 12 and a pair of lines along the 8 foot sides are termed side boundaries 13. A quarter inch broad white line, termed the center line 14, is parallel with and centered between the side boundaries. A quarter inch broad white line, termed the net line 15, is parallel with and centered between the end boundaries. A barrier means in the form of a net 16 is located above this net line 15, supported by a plurality of supports 17 which extend not more than 6 inches outwardly from the table sides. The net 16 may be that of a standard table tennis game. The net 16 and net line 15 divide the playing surface into two equal courts. The center line 14 divides each court into equal half courts.

A pair of one-half inch broad blue lines, termed single service lines 18, 12 inches apart, are parallel with and centered between the side boundaries. The dark grey area between the single service lines 18 is termed single service path 19. When the game is played between two players, the server must serve the ball into the opponent's court so that it touches the singles service path 19, between the single service lines 18, without touching the net.

A pair of ½inch broad red lines, termed double service lines 20, about 16 to 17 inches apart, are parallel with and equidistant from an imaginary line, connecting two diagonal corners as shown. The dark grey area between the double service lines 20 is termed double service path 21. When the game is played with two players on a side, the server must serve the ball into the opponent's court so that it touches the doubles service path 21, between the doubles service lines 20, without touching the net.

In both singles and doubles play, the ball and paddle used are the same as is used in table tennis.

A quarter inch broad black line, termed the service line 22, on each court is parallel with the end boundaries and located 24 inches from the table end extending from the left single service line to the right double service line. In a "professional" match, but not necessarily in a "regular" match, a serve must first touch the server's court on the near side of the service line and then pass over the net and touch the receiver's court on the far side of the service line on the proper service path.

Each court has a 6 inch by 12 inch aperture 23, 33 inches from the table end and centered between the table sides. Each aperture 23 is overlapped by a 6 inch by 12 inch platform 24. The platform 24 is fixed to the inside of the back of the aperture 23 at about a 45° angle from the table surface, pointed so The open side is toward the opposite court.

Each half court has a 6 inch by 9 inch aperture 25, 15 inches from the table end and centered between the table side and the center line. Each aperture 25 is overlapped by a 6 inch by 9 inch platform 26. The platform 26 is fixed to the inside of the back of the aperture 25 at about a 35° angle from the table surface and pointed so the open side is toward the opposite court.

The interior of all apertures 23 and the surface of the platforms are black. The rest of the playing surface is dark green.

Each platform 24, 26 has a thickness which is the same as the table thickness. This assures a uniform bounce to the ball regardless of the surface struck.

A ball may strike a platform in many ways with differing results. If a ball strikes a platform during a serve, the serve does not count. If, after a good serve, a ball in play touches a platforms on the opponent's side, the ball must be returned before it touches the opponent's playing surface or platform again, or the point is awarded to the player. However, if it is not returned by the opponent and the ball, after it touches the opponent's platform, fails to touch the player's court, then the point is awarded to the opponent. Similarly, if the ball hits the opponent's platform and goes straight up and down, the point is awarded to the opponent. But, if, after a good serve, a player returns the ball so that it hits the opponent's platform and then returns in the air to his own court, it is the same as his opponent making a good return. On the other hand, if the ball touches the opponent's playing surface first and then on the upward bounce touches the opponent's platform, the point is awarded to the opponent.

If a ball goes into an aperture on a player's court before touching the playing surface, double points are awarded to the player's opponent. If the player returns the ball so that it touches an opponent's platform and returns in the air to the player's aperture, two points are awarded to the opponent.

FIGS. 4 and 5 show an alternate embodiment of the invention including a ball return arrangement 27. Components and markings, unchanged from FIGS. 1, 2 and 3 are labled as in those figures. Although such a ball return arrangement 27 is only shown for one side of the table it will be understood that such an arrangement could be used for both sides of the table.

Suspended below each court of the playing surface 11 of table 10 is a sloping shelf 28. The lowest part of each shelf is below the end of the table. The shelf does not extend beyond the table end and so does not interfere with the players. A ball falling through any aperture 23 and 25 falls upon the shelf 28 and rolls toward the end of the table. A stop 29 is provided to keep the ball on the lowest part of the shelf 28 and to prevent its rolling off onto the floor. A pair of side walls 30 are similarly provided to keep the ball on the shelf. It is important to remember that an area 21 above the shelf 28, adjacent to stop 29, must be open and large enough so that a player can insert his hand to retrieve the ball so that the play can be resumed.

Figures 6, 7, 8:
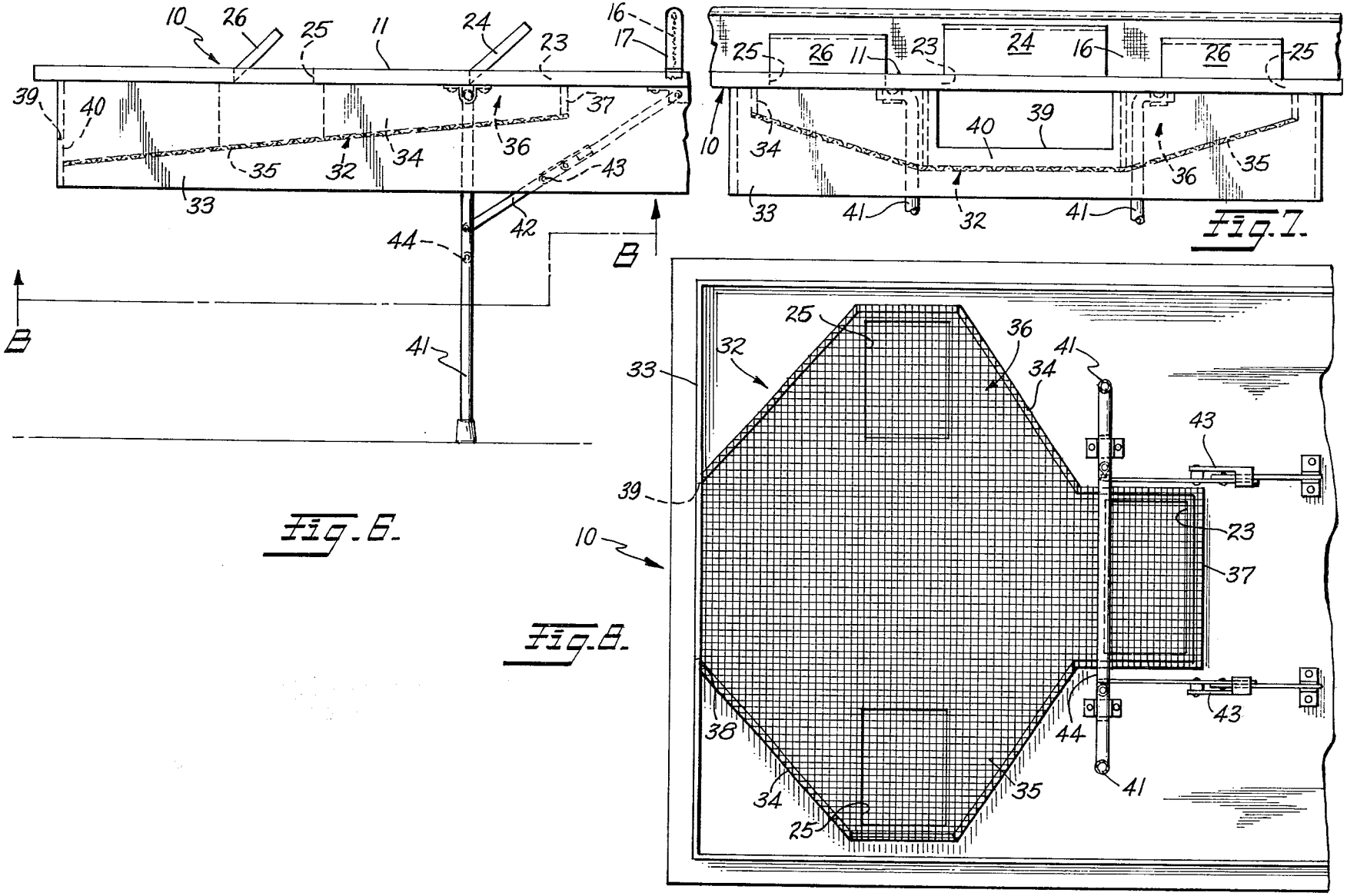
FIG. 6 is a fragmentary side elevational view illustrating a modification of the table game.
FIG. 7 is a fragmentary end elevational view of the table game of FIG. 6, as viewed from the left thereof.
FIG. 8 is a fragmentary bottom plan view, partly in section, as viewed on the line 8—8 of FIG. 6.

FIGS. 6, 7 and 8 show a further embodiment of the invention including an alternate ball return arrangement 32. As with FIGS. 4 and 5 components and markings, unchanged from FIGS. 1, 2 and 3 are labled as in those figures. Dimensions given are merely representative of a preferred embodiment and other dimensions could be used. As before, although such a ball return arrangement 32 is only shown for one side of the table it will be understood that such an arrangement could be used for both sides of the table.

Suspended below the playing surface 11 of table 10 and enclosing the underside of table 10 is an eight inch apron 33, set back from the edge of table 10 as shown. Suspended below the apertures 23 and 25 and abutting the apron 33 is a skirt 34. A screen 35 is attached to the bottom the the skirt 34 and to the inside of the apron 33 as shown. The skirting, screen and apron combination form a cage 36 which traps the balls that fall through the apertures 23 and 25. An advantage of this type of cage 36 over the sloping shelf 28 described with reference to FIGS. 4 and 5 is the tendency of a ball not to bounce when landing on screen 35. So that the ball landing on the screen will roll toward the apron, that part of the skirting 34 farthest from the playing end of the table, indicated at 37, is only 1 inch deep while the edge of the skirting abutting the apron, indicated at 38, is 6 inches deep. The rest of the skirting 34 has a depth uniformly varying from part 37 toward edge 38 thus providing a slope to screen 35. In order to retrieve a ball that has rolled down the sloping screen 35, and come to rest against the apron 33 a 12 inch wide by 4 inch deep opening in apron 33 provides access into cage 36. By situating opening 39 against the table 10 a 2 inch lip 40 is provided which acts as a stop against which the rolling ball comes to rest. Naturally, as shown in FIG. 8, the sides of the cage 36 sould funnel toward opening 39.

In the embodiment shown in FIGS. 6, 7 and 8, 28 inch high folding table legs 41 are used. Such folding table legs 41 are usually supported by a collapsible bracket 42, which bracket is provided with a toggle joint 43. A cross-piece 44, connecting legs 41, adds rigidity thereto. As shown in FIG. 8, the outer periphery of cage 36 must be designed so as not to interfere with the collapsing of bracket 42 nor the folding of legs 41; nor must the legs 41, bracket 42, and crosspiece 44 interfere with the cage 36.

Although a preferred embodiment of the table game has been described, alternative embodiments will be readily apparent to those skilled in the art. For example the table may be constructed so as to have only two apertures and platforms in the rear of each court. Alternatively, a smaller table could be used; a game using such a table requiring more skill than luck. Such alternative embodiments, and others, do not depart from the scope of my invention which is indicated by the appended claims.

What I claim is:

1. A table game played with paddle and ball and including:

a. a playing surface;

b. a plurality of apertures formed in said playing surface for catching the ball, each aperture being larger than the diameter of the ball;

c. a plurality of platforms set at an angle to the playing surface, each platform projecting over an associated aperture to partially inhibit the aperture catching ball; and d. means on said table dividing said playing surface into equal courts, each court containing the same number of said plurality of apertures and platforms, each platform being set along one edge of its associated aperture, the opposite edge of the aperture being toward the opposite court, one of the platforms in each court being set at a first angle and another one of the platforms in each court being set at a second angle.

2. A table game as described in claim 1 wherein the platform set at the first angle is closer to, and wherein the platform set at the second angle is farther from, the opposite court.

3. A table game as described in claim 2 wherein said first angle is about 45 degrees and said second angle is about 35°.

4. A table game as described in claim 1 and further including a ball return arrangement suspended under said playing surface, at least one of said apertures in said playing surface being over said ball return arrangement so that a ball caught by said aperture will land in said ball return arrangement and roll toward the end thereof.

5. A table game as described in claim 4 wherein said ball return arrangement includes a sloping shelf.

6. A table game as described in claim 4 wherein said ball return arrangement includes a sloping screen cage.

7. A table game played with paddle and ball and including:

a. a playing surface;

b. a plurality of apertures formed in said playing surface for catching the ball, each aperture being larger than the diameter of the ball;

c. a plurality of platforms set at an angle to the playing surface, each platform projecting over an associated aperture to partially inhibit the aperture catching the ball; and d. a plurality of markings on said playing surface, one of said plurality of markings being a net line equidistant between the edges of the playing surface, and barrier means supported over said net line, said net line and said barrier means dividing said playing surface into two equal courts.

8. A table game as described in claim 7 wherein another of said plurality of markings is a center line running perpendicular to and bisecting said net line, said center line traversing both courts and dividing each of said courts into equal half courts.

9. A table game as described in claim 8 wherein each of said half courts has an aperture and associated platform located thereon and wherein each of said courts has an additional aperture and associated platform located on said center line.

10. A table game as described in claim 7 wherein a first set of lines of said plurality of markings indicates a singles service path on said playing surface and wherein a second set of lines of said plurality of markings indicates a doubles service path on said playing surface, both of said singles and said doubles service paths traversing both courts.

11. A table game as described in claim 10 wherein an additional marking in each court is a service line running across both of said singles and said doubles service paths, each service line being parallel to said net line.

* * * * *